United States Patent [19]

Håkansson

[11] Patent Number: 4,538,581

[45] Date of Patent: Sep. 3, 1985

[54] DEVICE FOR MEASURING THE LOAD ON A TURBO-CHARGED DIESEL ENGINE, ESPECIALLY FOR REGULATING THE INJECTION TIMING IN DEPENDENCE THEREON

[75] Inventor: Nils O. Håkansson, Stenkullen, Sweden

[73] Assignee: AB Volvo, Gothenburg, Sweden

[21] Appl. No.: 328,644

[22] Filed: Dec. 8, 1981

[30] Foreign Application Priority Data

Dec. 16, 1980 [SE] Sweden ..... 8008834

[51] Int. Cl.[3] ..... F02M 39/00

[52] U.S. Cl. ..... 123/502; 123/383

[58] Field of Search ..... 464/1, 2, 3; 123/502, 123/382, 383, 385, 386, 387

[56] References Cited

U.S. PATENT DOCUMENTS 3,486,492 12/1969 Lehnerer ..... 123/502
3,742,925 7/1973 Gordon ..... 123/502
4,305,366 12/1981 Imasato ..... 123/502

FOREIGN PATENT DOCUMENTS 1751770 8/1971 Fed. Rep. of Germany ..... 123/502
2532830 1/1977 Fed. Rep. of Germany ..... 123/383
2736317 2/1978 Fed. Rep. of Germany ..... 123/385
2747083 5/1979 Fed. Rep. of Germany ..... 123/383

*Primary Examiner*—Carl Stuart Miller
*Attorney, Agent, or Firm*—Young & Thompson

[57] ABSTRACT

The invention relates to an injection regulator for adjusting the injection timing in a turbo-charged diesel engine depending on the engine speed and load. The regulator comprises a valve controlled by a centrifugal regulator and which produces an oil pressure varying as the square of the r.p.m., and a device loaded by the engine charging pressure. The oil pressure force and the charging pressure force are used to control a pair of slide valves, which regulate the oil pressure in a plunger-cylinder arrangement, by which the injection timing can be adjusted.

3 Claims, 10 Drawing Figures

Figure 1:
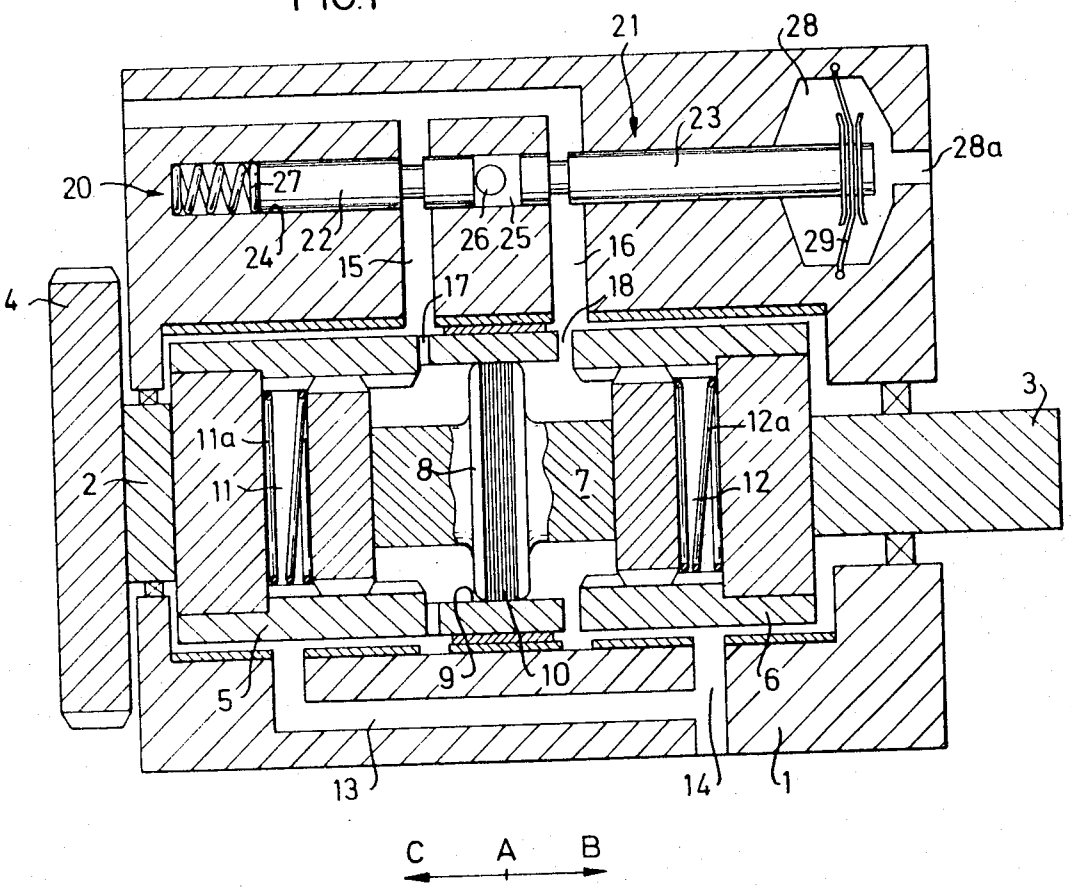

DEVICE FOR MEASURING THE LOAD ON A TURBO-CHARGED DIESEL ENGINE, ESPECIALLY FOR REGULATING THE INJECTION TIMING IN DEPENDENCE THEREON

The present invention generally relates to a device for continuous measurement of the operating state of a turbo-charged diesel engine with regard to rotational speed and load. The invention relates particularly to a device of this type in combination with an injection regulator, designed to be connected to the engine fuel injection pump and by means of which the injection timing is variable as a function of both the load and speed of the engine.

The injection timing which produces the highest efficiency of a diesel engine varies with the engine speed and load on the engine. The injection timing at various r.p.m. and loads also determines the percentages of toxic emissions in the exhaust. A common method of reducing the percentage of nitrogen oxide for example, in the engine exhaust is to retard the injection timing. This causes, however, the percentage of uncombusted hydrocarbons and the amount of smoke to increase at the same time as it has a negative effect on engine efficiency.

The greatest amount of nitrogen oxide is formed at high load on the engine and relatively low r.p.m., i.e. at high temperature in the combustion chamber and a long period of time at this high temperature, while the percentages of uncombusted hydrocarbons are greatest at high r.p.m. and low loads because of incomplete combustion, i.e. short time available for combustion and low combustion rate due to low temperature.

By retarding the injection timing when the formation of nitrogen oxide is most intensive, and advancing it when the formation of uncombusted hydrocarbons dominates, it is possible to reduce the percentages of toxic emission in the engine exhaust. In order to do this, the engine speed and load must be measured and these parameters used to control an injection regulator.

The most common method used today is to make the injection timing only dependent on the engine speed, using a centrifugal regulator. Various parameters for the amount of fuel have been used, however, for load measurement, e.g. the setting of the fuel regulator means. In a known design for achieving load-dependent adjustment of the injection timing, a pump member with a helical upper ridge is used to retard to advance the timing on the pump member, which is turned to vary the amount of fuel. The disadvantage of this system is the minimal freedom for variation of the injection timing, which is determined by the normal dimension of the pump member, manufacturing and adjustment possibilities. The greatest disadvantage of using the amount of fuel as a parameter for engine load, is that it is very difficult to produce a usable signal without complicated amplification, e.g. electronically.

The purpose of the present invention is generally to achieve a simple and reliable device by means of which it is possible to continuously measure the engine load without using the amount of fuel as a parameter. A particular purpose of the present invention is to achieve a device of this type which is integrated in an injection regulator for varying the injection timing dependent on both the load and engine speed.

The general purpose of the invention is achieved by means of a device which has first means for producing a signal which is at least approximately proportional to the square of the rotational speed of the engine, second means for producing a signal proportional to the engine charging pressure and third means for comparing said signals and producing an outward signal representing the engine load.

The invention is based on the fact that the charging pressure of a turbo-charged diesel engine at constant mean pressure within the operating range of the engine, increases approximately proportionally to the square of the engine speed. By allowing the charging pressure to produce a signal and comparing it to a signal produced by a centrifugal device for example controlled by the engine r.p.m. (that is to say generally a device which produces a signal proportional to the square of the r.p.m.), it is possible to determine the mean pressure of the engine, i.e. the load.

Figure 2:
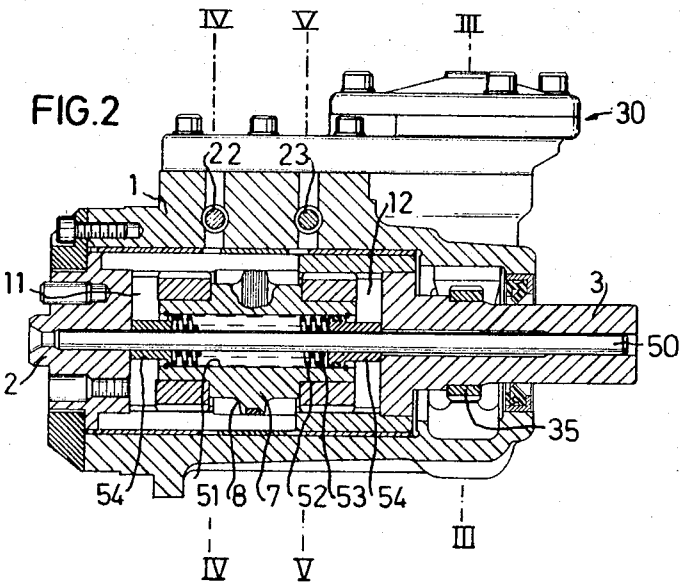
Figure 5:
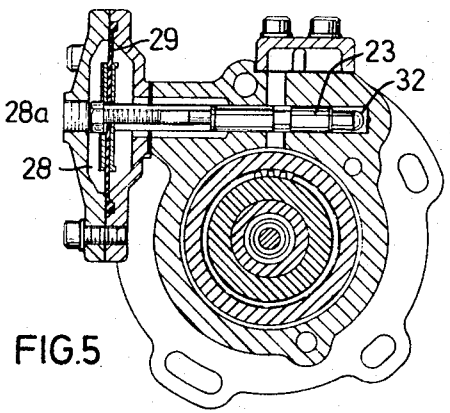
Figure 3:
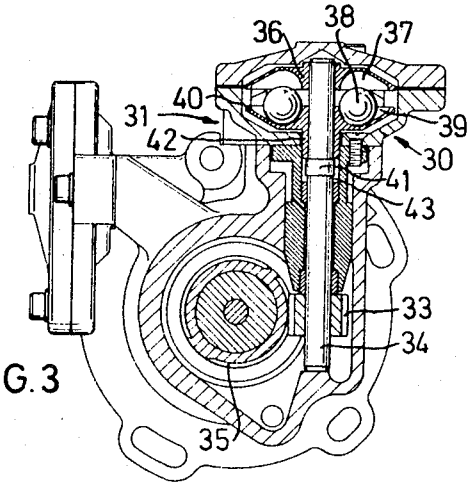
Figure 4:
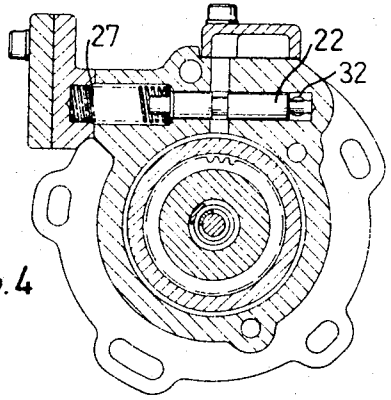

The invention will be described in more detail with reference to the examples shown in the accompanying drawings, of which FIG. 1 shows a longitudinal section through a schematically represented injection regulator illustrating a preferred application of the device according to the invention, FIG. 2 is a longitudinal section through a corresponding injection regulator in a practical embodiment, FIG. 3 is a cross-section along the line III—III in FIG. 2, FIG. 4 is a cross-section along the line IV—IV in FIG. 2, FIG. 5 is a cross-section along the line V—V in FIG. 2 and FIGS. 6–10 are various diagrams showing possible divisions of the working range of the engine for shifting the injection timing.

The injection regulator shown in FIG. 1 has a housing 1, in which an input shaft 2 and an output shaft 3 are rotatably journalled. The input shaft 2 has a gear 4 which is designed to be driven from the crankshaft of a turbo-charged diesel engine, while the output shaft 3 is designed to be connected to the fuel injection pump of the engine for driving the same. The input shaft 2 is rigidly fixed to a sleeve 5 and the output shaft to a sleeve 6. The sleeves 5 and 6 are made with internal helical splines, cut in opposite directions, so that axial displacement of a power transmitting element 7 engaging the sleeve splines, results in angular adjustment between the shafts 2,3 which in turn leads to a change in the injection timing.

The power transmitting means 7 is made in one piece with a plunger 8 which is held in a cylinder portion 9 and is in contact with the wall of the cylinder portion 9 by means of a seal 10. On either side of the plunger 8, the sleeves 5 and 6 define cylindrical chambers 11 and 12, which can be supplied with pressure fluid via the inlet channels 13,14 and can drain via the outlet channels 15,16 in the housing 1. The chamber 11 communicates with the channels 13,15 via the holes 17 in the sleeve 5, while the chamber 12 communicates with the channels 14,16 via the gap 18 between the sleeves 5, 6. If there are equal pressures in the cylinder chambers 11,12, the springs 11*a*, 12*a* will hold the element 7 in the central position shown in FIG. 1, and at different pressures the element 7 is displaced to either side of the center position.

The regulation of the pressure in the two cylindrical chambers 11,12 is achieved with the aid of a pair of slide valves 20,21 at the outlet side of the cylinder chambers. The left hand valve 20 has a valve slide 22, which in the position shown permits draining of the chamber 11 via the outlet 15. The right hand valve 21 has a valve slide 23 which in the position shown, in a corresponding manner, permits draining of the chamber 12 via the outlet 16. The slides 22,23 are arranged in a common bore 24 in the housing 1. In the space 25 in the bore 24 between the facing inner end of the slides, a channel 26 opens, through which pressure fluid can be supplied from a valve (not shown) connected to a pressure source and controlled by a motor driven centrifugal device, so that during operation a pressure proportional to the square of the engine speed is obtained in the space 25 in the bore. Between the outer end of the slide 22 and the end wall of the bore 24, there is placed a helical spring 27, which is shown in the figure in the expanded, unloaded state. The outer end of the slide 23 extends into an air chamber 28 and is fixed to a membrane 29 mounted in the chamber 28. The chamber 28 has a port 28*a*, which is designed to be connected to the pressure side of a turbo-compressor, so that the membrane 29, and thereby the slide, will be loaded during operation by a force dependent on the charging pressure. In the position shown in the figure, the membrane is not loaded.

The valve slide 22 is thus loaded on one side by the pressure of the pressures fluid, e.g. oil, and on the other side by the spring 27. At a certain oil pressure corresponding to a predetermined engine r.p.m., which is determined by the choice of spring, the forces on the valve slide 22 are in equilibrium and the outlet 15 is kept open. At an r.p.m. higher than this, the oil pressure force dominates and the valve slide 22 is forced to the left in FIG. 1, blocking the outlet 15 of the cylinder chamber 11, resulting in an increase in pressure in the chamber 11. Assuming that the valve slide 23 remains in the open position shown in FIG. 1, an increase in pressure in chamber 11, will cause the element 7 to be displaced from its center position A to a position B to the right of the center position A, resulting in an angular readjustment between the input and output shafts 2,3, thus advancing the timing from position A.

The load on the engine which results in a balance between the forces acting on the valve slide 22, is determined by the ratio between the cross-sectional area of the slide, on which the oil pressure acts, and the effective membrane area on which the charging pressure acts. For motor loads greater than the selected value for equilibrium, the charging pressure force is greater than the oil pressure force, thus forcing the valve slide to the left in FIG. 1 and closing the outlet 16 to the cylinder chamber 12. This moves the element 7 to the left to a position C, providing that the slide 22 remains open. The accompanying angular readjustment between the shafts 2,3 causes the injection timing to be retarded from that in position A.

Figure 6:
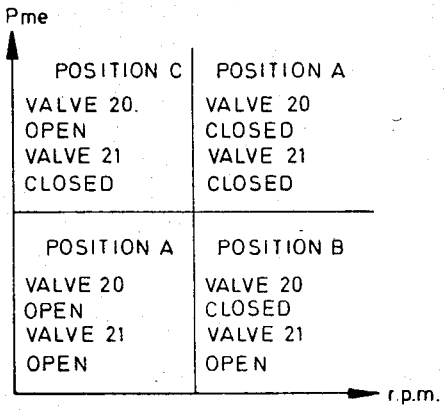
Figure 7:
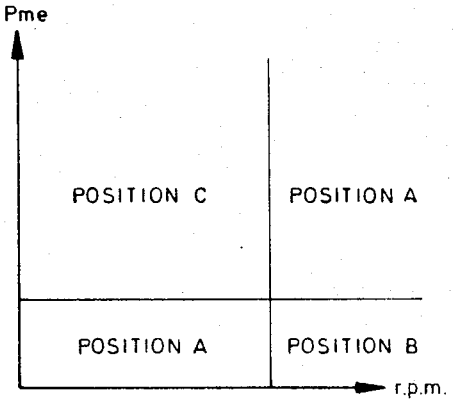
Figure 8:
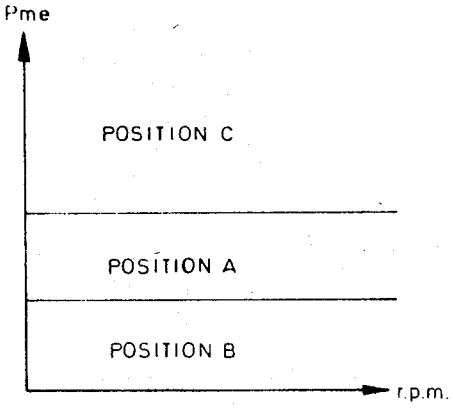
Figure 9:
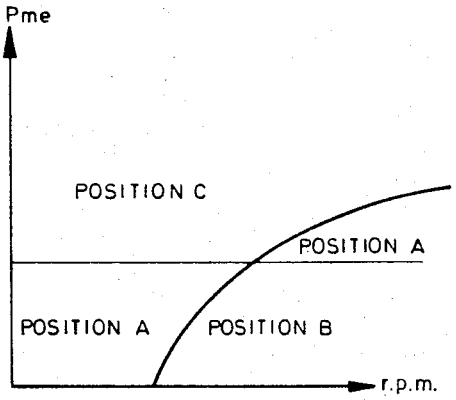
Figure 10:
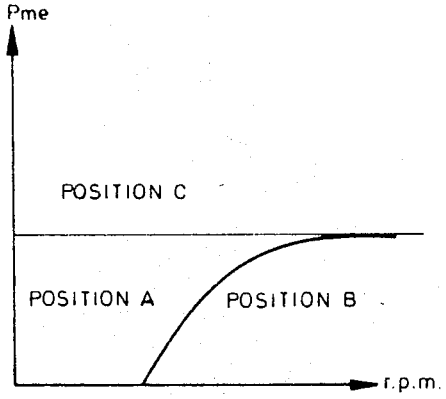

The operational graph of the engine is divided into four regions, as represented in FIG. 6, in which the regions representing the positions A, B and C, can be selected as desired provided that A corresponds to a position between B and C. Examples of other divisions for shifting the injection timing within the operating range of the engine, which are possible to achieve with the basic control principle described, are illustrated in the diagrams of FIGS. 7–10.

In FIGS. 2–5, in which the same reference numerals were used as in FIG. 1 for corresponding parts, the injection regulator according to the invention is shown in a practical embodiment, which differs from the one described above primarily in that the housing also contains a valve 31 controlled by a centrifugal regulator, said valve controlling the oil pressure which loads one side of the valve slides 22,23, which are also arranged in individual bores which communicate with each other via a channel 32 from the valve 30.

The centrifugal regulator has a rotatably mounted shaft 34 with a gear 33. A helical driving gear 35 on the output shaft 3 engages the gear 33 to drive the shaft 34. At its upper end, the shaft 34 is fixed to a member 36 with a number of ball shaped depressions 37 for balls 38. A corresponding member 40 with depressions 39 is displaceably journalled on the shaft 34 above a flange 41 on the shaft. The member 40 has a cylindrical extension 42 which forms the valve body of the valve 31, regulating the fluid discharge from an underlying chamber 43, which communicates with the channel 32.

The injection regulator in FIGS. 2–5, as well as that in FIG. 1, are assumed to be coupled to the ordinary lubrication system of the engine and are supplied with oil from the engine oil pump. The chamber 43 is supplied with oil in a manner not shown in more detail here, via a constriction and the oil pressure in the chamber 43 thus acts on the member 40 with an upwardly directed force, while the centrifugal force on the balls, as the shaft rotates, produces a downwardly directed force on the member 40 because of the shape of the depressions 37,39. At low r.p.m., the oil pressure force dominates and lifts up the member 40, so that the chamber 43 is drained by oil leaking out between its edge and the valve body 42. At higher r.p.m. the centrifugal force dominates and the member is pressed down by the balls 38 into the position shown in FIG. 3. An oil pressure proportional to the square of the engine speed is thus produced in the channel 32 leading to the bores of the valve slides 22,23.

In the injection timing regulator in FIGS. 2–5, the element 7 is displaceably mounted on a shaft 50 which extends between the input and output shafts 2,3 and is rotatable relative thereto. In a central bore 51 in the element 7, a pair of springs 52,53 are mounted between a pair of end bushings 54, which see to it that the element 7 is kept in the center position when the pressures are equal in the cylinder chambers.

The functional principle of the invention has been described in the preceding with reference to a hydraulic embodiment, but other embodiments are also possible. For example, it is possible to allow a device to create an electrical voltage which is proportional or nearly proportional to the square of the engine speed and to compare this voltage firstly with a voltage produced by a sensor producing a voltage proportional to the charging pressure of the engine to obtain a load signal, and secondly with a given constant voltage to obtain the r.p.m. signal. Synonymously with the principle of the above described embodiment, the result of this comparison is used to produce an output for directional actuation.

What I claim is:

1. Device for regulating the fuel injection timing of a turbo-charged diesel engine, comprising an centrifugal device driven by the engine and producing a hydraulic force proportional to the square of the rotational speed of the engine, a pair of first and second hydraulic slide valves, spring means acting continuously on said first valve, means for continuously applying charging pressure of a said engine to said second valve, means for continuously applying said hydraulic force to said first and second slide valves in directions opposite to the directions in which said spring means and said charging pressure respectively act, an injection adjustor having an input shaft adapted to be driven by a power take-off of a said engine and an output shaft adapted to be connected to an injection pump of a said engine and power transmitting means between said shafts adapted to vary the relative angular position of the shafts, and hydraulic circuit means for actuating said power transmitting means, said circuit having a first conduit controlled by said first valve and a second conduit controlled by said second valve, said first valve acting on said first conduit when said hydraulic force predominates over said spring means to actuate said power transmitting means to advance said timing, said second valve acting on said second conduit when said charging pressure predominates over said hydraulic force to actuate said power transmitting means to retard said timing.

2. Device as claimed in claim 1, in which said power transmitting means comprises an axially slidable plunger mounted between the ends of said shafts said engaging the respective shafts by helical splines, said first and second conduits communicating with opposite sides of said plunger for moving said plunger relative to said shafts thereby to shift the relative angular position of the shafts.

3. Device as claimed in claim 1, said hydraulic circuit means comprising a single hydraulic circuit of which said first conduit is a branch and said second conduit is another branch.

* * * * *